United States Patent [19]

Traut

[11] Patent Number: 5,038,544

[45] Date of Patent: Aug. 13, 1991

[54] METHOD AND APPARATUS FOR SEALING BUILDING EXTERIOR PERFORATIONS

[75] Inventor: Werner J. Traut, Laguna Hills, Calif.

[73] Assignee: Werner Engineering, Inc., Corona, Calif.

[21] Appl. No.: 400,551

[22] Filed: Aug. 29, 1989

[51] Int. Cl.[5] ..... E04C 5/00; E04F 19/02

[52] U.S. Cl. ..... 52/717.1; 52/698

[58] Field of Search ..... 52/209, 293, 717, 461, 52/463, 465, 300, 410, 698; 411/377, 373, 429, 910, 258

[56] References Cited

U.S. PATENT DOCUMENTS

| | | | |
|---|---|---|---|
| 3,160,247 | 12/1964 | Masters | 52/293 X |
| 3,470,787 | 10/1969 | Mackie | 411/377 |
| 3,991,537 | 11/1976 | Brown | 52/717.1 |
| 4,590,730 | 5/1986 | Blendick | 52/461 |
| 4,624,092 | 11/1986 | Baginski | 52/410 |
| 4,718,211 | 1/1988 | Russell et al. | 52/410 |

FOREIGN PATENT DOCUMENTS

| | | | |
|---|---|---|---|
| 3642537 | 6/1988 | Fed. Rep. of Germany | 411/377 |
| 725564 | 3/1955 | United Kingdom | 52/465 |

*Primary Examiner*—Michael Safavi

*Attorney, Agent, or Firm*—Wayne P. Sobon

[57] ABSTRACT

Methods and apparatus for sealing perforations in windows, curtain wall and other building fixtures are disclosed. The present invention enables the construction of building exteriors impervious to water leakage through holes in sills and other building exterior components. a molded plastic cap [10] is secured around each exterior hole [20] and fastener [16,18] with an adhesive [22]. The cap prevents water from leaking through the exterior hole into the building interior while allowing sills and exterior sections to move in response to thermal, seismic and other mecahnical changes. By not coming into contact with the fastener [16,18] and hole [20], the seal [10] avoids any possible contamination and chemical degradation from the fastener materials.

3 Claims, 3 Drawing Sheets

METHOD AND APPARATUS FOR SEALING BUILDING EXTERIOR PERFORATIONS

FIELD OF THE INVENTION

This invention pertains to building exteriors and assemblies, and more particularly to methods and apparatus for sealing perforations in exterior building components.

BACKGROUND OF THE INVENTION

The exterior of a building shields the interior from outside environmental agents, from wind, rain and uncomfortable temperatures. A building's exterior may comprise a window that is set within a masonry or steel structure, or a solid wall of windows as in many modern skyscraper buildings. It may instead consist of a "curtain wall" of stone or metal slabs, or it may be any combination of these elements. Typically, these surface components are attached to the exterior of the building with a sill or "sill can", along with other perimeter support fixtures. FIGS. 1 and 2 illustrate a common arrangement. The sill 1, usually but not necessarily a trough extruded out of light weight aluminum, holds the window or curtain wall assembly 2 in place, seating it against the inner structure of the building 7.

The sill 1 possesses a distribution of holes or perforations (center hole 3 and elongated holes 4) through which bolts 5 and nuts 6 fasten the sill and window/curtain wall assembly 2 to the structure of the building 7. Depending on the weight, dimensions and materials used for the exterior building elements, other similar fasteners such as screws or concrete expansion anchors will be used to secure the elements against the building. Many of the holes in a window or curtain wall sill are elongated to allow for normal expansion and contraction of the metal sill and its corresponding exterior section. The fasteners within these elongated holes may freely move forward and backward along the holes, letting the sill and window (or wall) "breathe" with the thermal expansions and contractions of day/night cycles and seasonal changes. The building must also respond elastically to the torsional effects of wind, seismic tremors and normal settling. If sills did not allow such expansion, the exterior building elements would experience enormous undesirable buckling forces, tending to shatter windows and deform walls. Further, the constant strains of repeated expansions could loosen and undo all the support bolts, allowing entire sections of building walls to fall out.

Including such elongated expansion holes into the sills, however, tends to defeat the original purpose of a building exterior: no longer does the sill and window/wall combination hermetically seal the interior from the exterior. Water which collects naturally in the troughs of the sills may slowly leak through the sill holes, damaging the interiors of buildings and possibly weakening their support structures. At a minimum, expensive interior furnishings and wall treatments could be ruined. Even more serious, though, is the possibility of shorting out electrical systems, raising the chance of fires. Further, concrete and steel structures remain sensitive to the erosive effects of water damage: by damaging these support members, long term leakage can render a building completely unsafe and unusable.

Current building practice often makes two efforts at preventing leakage of water into a building and at leading the collected water away from the building interior.

The first approach places weep holes 8, by drilling or some other appropriate method, at regular intervals in the exterior portion of each sill to allow trapped water to drain to the exterior of the building. But even with weep holes, a certain amount of water may remain in the sill due to exterior, positive wind pressure. And since in any case drainage takes time, the pool of draining water still has an opportunity to leak through the sill's fastener holes into the building.

Builders attempt to further prevent accumulated water from entering the building by applying some form of a sealant 9, typically a type of silicone adhesive, around the fasteners and holes in each sill can. By physically filling up these gaps in the sill, builders hope to completely prevent leakage. But again, the sill's elongated holes exist to allow normal expansion and contraction of the exterior. Hence, the silicone seals suffer shearing forces from the thermal movement of the window/sill assembly and must be able to take the compressions and extensions repeatedly over a long period of time. But, like most elastically stressed elements, many silicone seals simply cannot perform faithfully forever. They may eventually work loose or rupture, allowing water once again to leak into a building, often weeks or years after construction has finished.

In addition, if the silicone and other plastic seals physically contact the fastener, whether screw, bolt or concrete anchor, the metals and chemicals of the fastener may attack the sealant material. By allowing oxidation and chemical degradation of the sealant, this contact between fastener and sealant can, independent of any thermal stresses, cause failure of the seals and lead to damage of building interiors and structures. Hence, any perforation of a building's exterior, where fixtures such as lighting elements, chimney flues, advertising displays, etc. are attached with fasteners that are then sealed over, remains vulnerable to sealant failure and consequent interior damage.

The building construction industry has faced a great challenge to find ways to seal and protect the interiors of offices and homes from the exterior, harsh elements. A method of sealing building perforations against water leakage and other environmental agents, which withstands harmful expansions and contractions and also chemical degradations, would represent a major technological advance. The ability to cheaply and reliably seal a building's exterior would satisfy a long-felt need within the industry and offer to the contracting industry a versatile, faithful and inexpensive sealing method and device.

SUMMARY OF THE INVENTION

The method and apparatus for sealing perforations in building exteriors claimed in this patent application overcomes the problems inherent in ordinary seals when they physically contact exterior fasteners. The present invention overcomes both the inherent thermal stretching and shearing of ordinary seals and any material degradation caused by contact with the fasteners themselves. By loosely surrounding the sill hole and fastener with a seal cap, the present invention avoids coupling the seal with the fastener thereby eliminating any thermal shearing or chemical decomposition of the seal.

The seal in accordance with the present invention comprises a hat-shaped molded cap. The cap may be formed out of any useful plastic, preferably silicone, and may be attached to the sill (or other appropriate building perforation), around the fastener and hole, with any suitable adhesive, also preferably silicone. Use of the seal cap disclosed and claimed in this patent application provides a rugged, lasting and inexpensive device and method for sealing window and curtain wall sills to buildings. Importantly, the invention has wide-ranging utility for any application where ordinary contact seals face either thermal or chemical degradation from being in contact with a fastening means.

An appreciation of other aims and objectives of the present invention and a more complete and comprehensive understanding of this invention may be achieved by studying the following description of a preferred embodiment and by referring to the accompanying drawings.

DESCRIPTION OF A PREFERRED EMBODIMENT

Figure 1A:
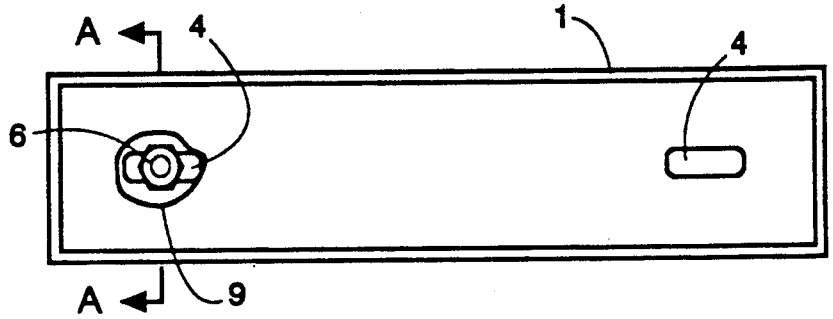
FIG. 1*a* is a top view of a sill can with fastener and sealant.
Figure 1B:
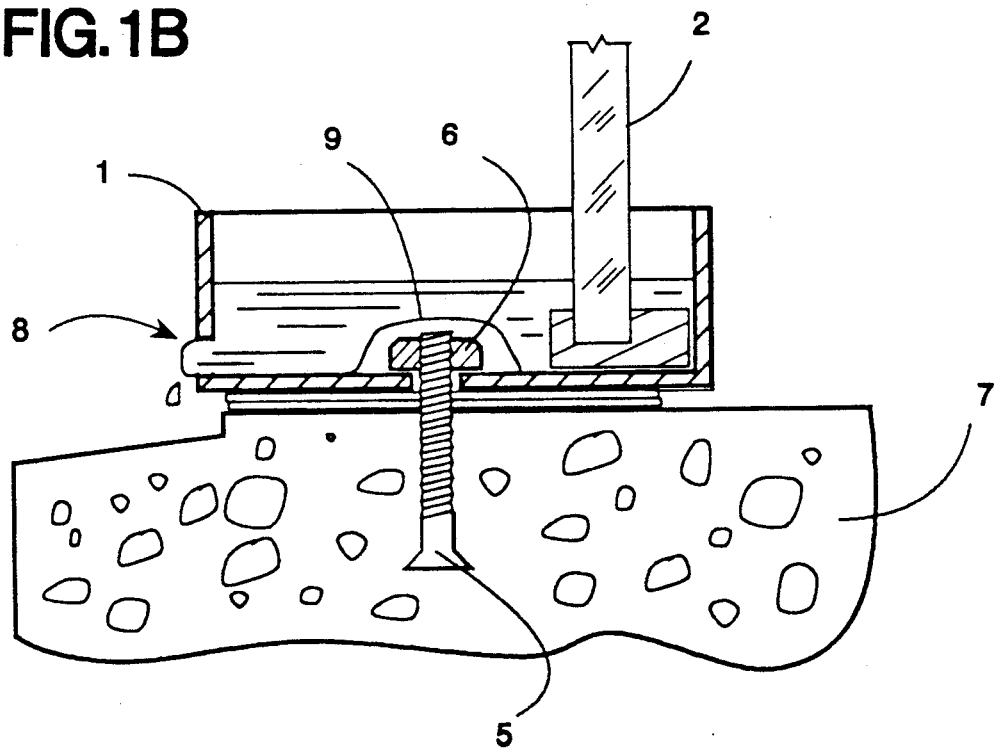
FIG. 1*b* is a cutaway side view of a sill can attached to a building structure.
Figure 2:
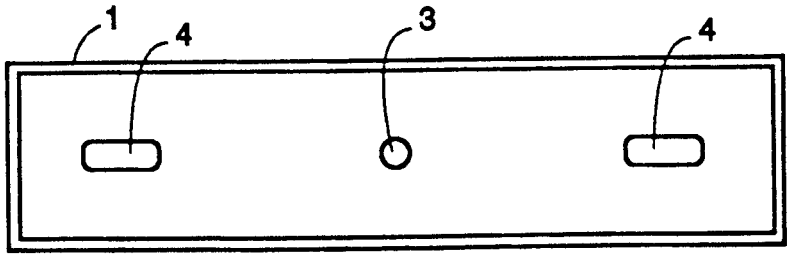
FIG. 2 is a top view of a sill can with center and elongated holes.
Figure 3A:
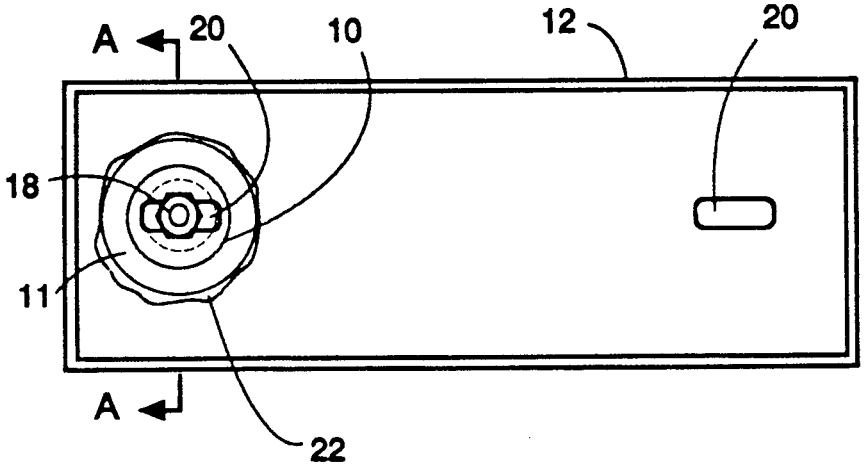
FIG. 3*a* is a top view of a sill can with a fastener sealed by a seal cap in accordance with the present invention.
Figure 3B:
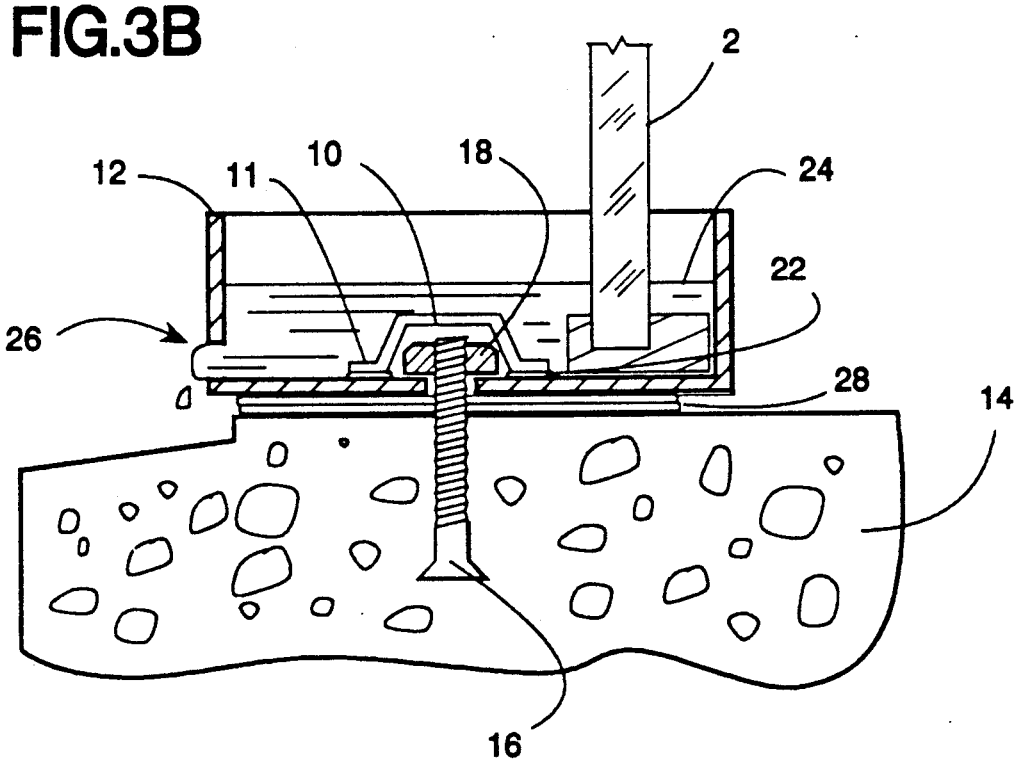
FIG. 3*b* is a cutaway side view of a sill can with a fastener sealed by a seal cap.

FIGS. 3A and 3B reveal an exterior building section incorporating the sealing methods and apparatus of the present invention. Window or curtain wall sill 12 bolts to a building section 14 with fastener 16 and nut 18. In order to prevent water leakage, seal cap 10 surrounds the nut 18 and the sill's elongated hole 20. The seal cap is preferably made from a translucent or transparent plastic such as silicone, allowing a person applying such seals to visually inspect the seal's proper placement. In the preferred embodiment, the cap is secured by the application of adhesive 22, such as silicone, although other methods of attachment such as clamping are also possible and may in certain circumstances be required. The cap 10 itself may be made with available injection molding equipment, although stamping from metal molds or other processes are equally suitable.

The adhesive used in the preferred embodiment is the 795 silicon building sealant manufactured by Dow Corning Corporation of Midland, Mich. It is suitable for forming durable, flexible, watertight bonds with most building materials such as glass, stone, masonry, wood, steel, and aluminum. It requires no mixing and may be applied at most temperatures. Installation of the seal caps is relatively simple. First, the surfaces for application should be cleaned in accordance with directions supplied by the sealant manufacturer. In the case of an aluminum sill, all foreign matter and contaminants such as oil, water, dirt and protective coatings should be removed and the surfaces cleaned with either a mechanical abrading method or solvent cleansing procedure or both.

The sealant should then be applied in a continuous bead around the perimeter where the flange 11 of the seal cap will seat against the metal sill's surface. To seal properly, the seal cap flange 11 should completely surround the particular hole 20 in the sill 12. The seal cap 10, depressed into the sealant bead, squeezes the sealant to form a bond optimally between $\frac{1}{8}''$ and $\frac{1}{2}''$ thick (ideal dimensions for this particular sealant). The sealant used in the preferred embodiment requires between 7 and 14 days time for full curing. After full cure, or at any convenient time, the seal caps and sealant bonds may be visually inspected through the semi-transparent caps for bad sealing and may be tested by filling the sills with water before final construction of the building interiors.

FIG. 3B shows the attached seal cap 10 protecting the fastener 16 and hole 20 from water leakage. The water 24 instead drains through weep hole 26. A shim 28 separates the sill can from the building section 14. By surrounding the fastener nut 18 and hole 20 instead of actually touching them (as current seals conventionally do), the seal cap 10 of the present invention remains unaffected by deleterious thermal shearing forces and from any potential chemical interaction between the fastener composition and the sealant. The seal cap 10 thus protects the interior of the building indefinitely from water leakage and damage.

Figure 4A:
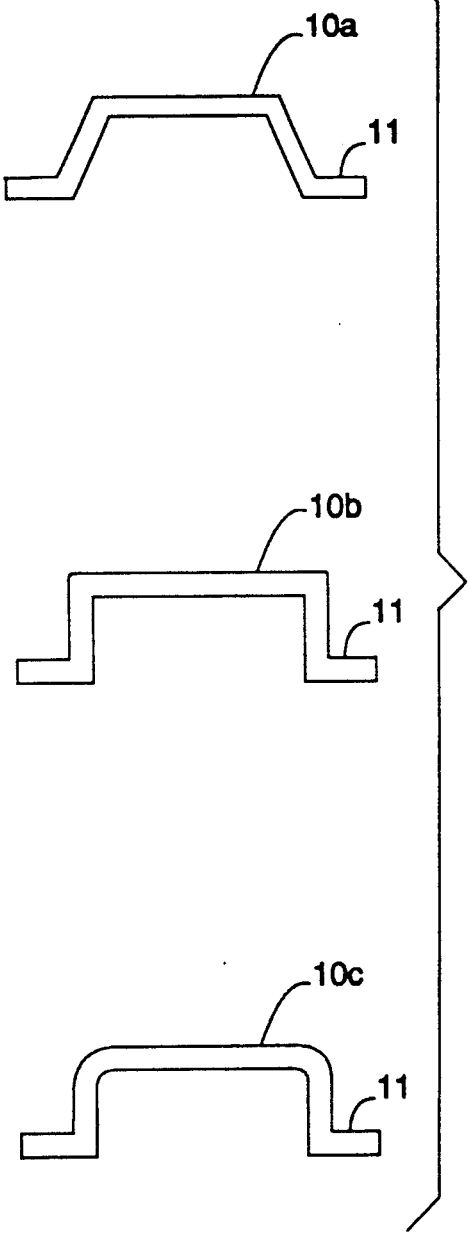
FIG. 4*a* reveals cutaway side views of several alternate embodiments of the seal caps of the present invention.
Figure 4B:
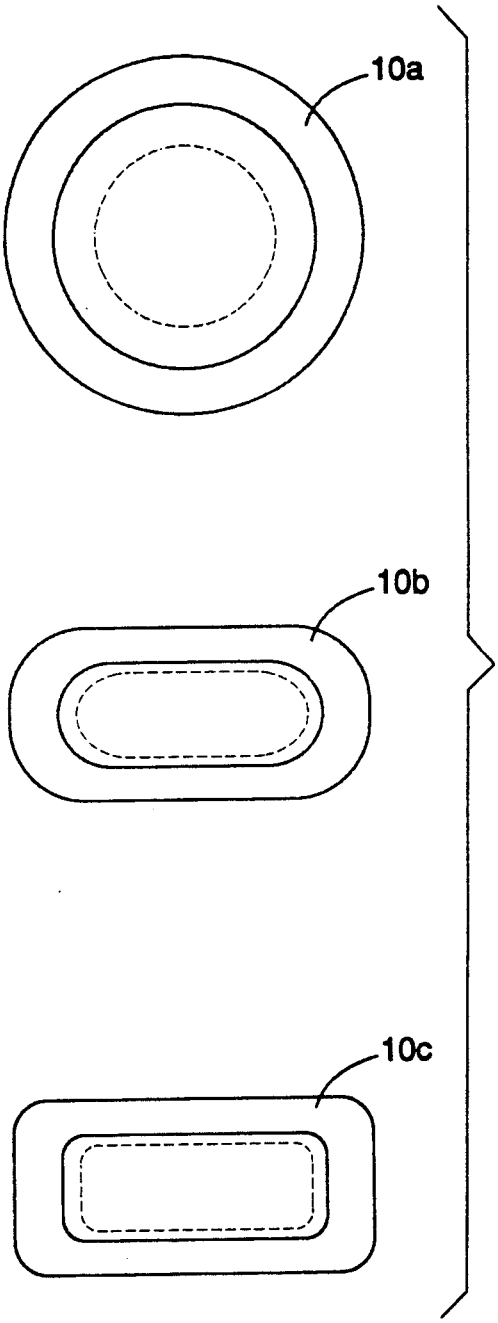
FIG. 4*b* shows top views corresponding to the cutaway side views of FIG. 4*a*.

FIGS. 4A and 4B reveal possible alternate configurations of seal cap 10, having round 10*a*, oval 10*b* or rectangular 10*c* footprints. The shapes of the particular sill holes 20 dictate the proper shape for the cap 10, in order to fully seal against water. For circular or other rotationally symmetric holes, a truncated conical-shaped cap would be appropriate. For elongated holes, the oval or rectangular footprints would be better. The width of the seal cap's flange 11 must be chosen in concert with instructions of the sealant manufacturer. For Dow Corning's 795 sealant, the company recommends a ratio of joint width to sealant depth of about 2:1 and a minimum width of about $\frac{1}{4}''$ for the sealant bead in joints where a good deal of movement is expected. A $\frac{1}{4}''$ wide flange was chosen and used with success in the preferred embodiment. If a different sealant is chosen, the instructions of its manufacturer should be followed.

It should be apparent that other applications, while following the general approach of the preferred embodiment, may use completely different materials and methods of attachment for seal cap 10. For example, the seal cap 10 may instead by formed out of metal, perhaps aluminum, and be joined either with the same silicone-type sealant or perhaps permanently welded into place. Or as mentioned, the flange of the seal cap assembly may be clamped into place by a gasket assembly around the flange perimeter.

In addition, the present invention finds application not just in sealing perforations in window and curtain wall sills, but in sealing any exterior hole in buildings. For example, the topmost building fixtures such as cornices and copings are also often bolted into place. At the roof level, everything from billboards to air conditioners are fastened to the exterior, again perforating the building's protective skin. At each fastening site, the present invention could safely and reliably seal against environmental damage. Indeed, the present invention remains useful in any application where a seal is necessary, but where the seal cannot be allowed to directly contact either a hole or its fastener, because of chemical or thermal risks.

The methods and apparatus for sealing sill cans disclosed are applicable to any sealing application where thermal stresses would tend to disable conventional silicone adhesive seals. Although the present invention has been described in detail with reference to a particular preferred embodiment, persons possessing ordinary skill in the art to which this invention pertains will appreciate that various modifications and enhancements may be made without departing from the spirit and scope of the claims that follow.

LIST OF REFERENCE NUMERALS

1. Sill or General Building Fixture
2. Window or Curtain Wall Assembly
3. Sill Center Hole
4. Sill Elongated Hole
5. Fastening Bolt
6. Fastening Nut
7. Building Section
8. Weep or Drainage Hole
9. Conventional Sealant
10. Seal Cap
12. Curtain Wall or Window Sill Can
14. Building Section
16. Sill Fastener
18. Sill Fastener Nut
20. Sill Fastener Hole
22. Seal Cap Adhesive
24. Accumulated Water
26. Weep Hole
28. Sill Can Shim

What is claimed is:

1. An apparatus for sealing a fixture to a building exterior, said fixture being attached to said building exterior with a fastener means, said apparatus comprising:

a cap means for shielding said fastener means; said cap means being coupled to said fixture; said cap means surrounding said fastener means without touching said fastener means; said cap means comprising a truncated conical-shaped cap; and a sealant means for coupling said cap means to said fixture; said sealant means not touching said fastener means.

2. An apparatus for sealing a fixture to a building exterior, said fixture being attached to said building exterior with a fastener means, said apparatus comprising:

a cap means for shielding said fastener means; said cap means being coupled to said fixture; said cap means surrounding said fastener means without touching said fastener means; said cap means comprising a substantially round body and a flange portion attached to one end of said round body; and a sealant means for coupling said cap means to said fixture; said sealant means not touching said fastener means.

3. An apparatus for sealing a fixture to a building exterior, said fixture being attached to said building exterior with a fastener means, said apparatus comprising:

a cap means for shielding said fastener means; said cap means being coupled to said fixture; said cap means surrounding said fastener means without touching said fastener means; said fastener means comprising a bolt and a nut; and a sealant means for coupling said cap means to said fixture; said sealant means not touching said fastener means.

* * * * *